US005806216A

United States Patent [19]

Renski

[11] Patent Number: 5,806,216

[45] Date of Patent: Sep. 15, 1998

[54] BASE EDGE COVER FOR A BUCKET AND APPARATUS FOR RETAINING SAME

[75] Inventor: William J. Renski, Peoria, Ill.

[73] Assignee: Caterpillar Inc., Peoria, Ill.

[21] Appl. No.: 733,887

[22] Filed: Oct. 18, 1996

Related U.S. Application Data

[63] Continuation-in-part of Ser. No. 536,904, Sep. 29, 1995, abandoned.

[51] Int. Cl.[6] ..... E02F 9/28

[52] U.S. Cl. ..... 37/458; 37/453; 37/454

[58] Field of Search ..... 37/446, 449, 450, 37/451, 452, 453, 454, 455, 456, 457; 172/772, 772.5, 753, 713; 403/378, 379

[56] References Cited

U.S. PATENT DOCUMENTS

| | | | |
|---|---|---|---|
| 1,695,113 | 12/1928 | Langton et al. | 37/456 X |
| 1,829,851 | 11/1931 | Clark | 37/452 |
| 1,890,981 | 12/1932 | Finkl | 37/454 |
| 3,286,379 | 11/1966 | Benetti | 37/452 |
| 3,312,002 | 4/1967 | Benetti | 37/452 |
| 3,312,003 | 4/1967 | Troeppl et al. | 37/457 |
| 3,463,523 | 8/1969 | Vasas | 37/456 X |
| 3,947,982 | 4/1976 | Mantovani | 37/450 |
| 3,959,901 | 6/1976 | Klett | 37/452 |
| 4,208,816 | 6/1980 | West | 37/452 |
| 4,602,445 | 7/1986 | Nilsson | 37/457 |
| 4,761,900 | 8/1988 | Emrich | 37/457 |
| 4,762,372 | 8/1988 | Rassmann et al. | 37/457 X |
| 4,811,505 | 3/1989 | Emrich | 37/457 |
| 4,965,945 | 10/1990 | Emrich | 37/456 |
| 5,068,986 | 12/1991 | Jones | 37/446 X |
| 5,564,508 | 10/1996 | Renski | 37/456 X |
| 5,634,285 | 6/1997 | Renski | 37/450 X |

*Primary Examiner*—Terry Lee Melius
*Assistant Examiner*—Victor Batson
*Attorney, Agent, or Firm*—O. Gordon Pence

[57] ABSTRACT

Apparatus is provided for protecting a base edge of a ground engaging implement of a work machine from wear. The apparatus includes a base edge cover and retaining apparatus of a construction adapted for time saving removal and installation. A mounting base is carried on the upper face of the base edge and has opposite sides and a outwardly opening cavity. The cavity has a concave frontal face thereon and a retainer opening through the one side in registry with the concave frontal face. A hook portion is provided on the base edge cover, which is adapted to be received within the cavity of the mounting base and positionable at a operative position where the convex face on the hook portion is disposed in a spaced opposing relation to the concave face in the cavity to define an arcuate groove therebetween. A curved retainer has a concave side and an opposite convex side and is adapted for receipt through the receiver opening into a retaining position within the arcuate groove such that the concave surface is disposed in close abutting relation to the convex face of the hook portion and the convex side is disposed in close abutting relation to the concave face of the cavity to restrict forward movement of the base edge cover relative to the mounting base.

12 Claims, 5 Drawing Sheets

66
65
14
46
62
72
30
74
12
22
18
32
8
24
10
28
16
20
68
52
36
56
26

BASE EDGE COVER FOR A BUCKET AND APPARATUS FOR RETAINING SAME

This application is a continuation-in-part of Ser. No. 08/536,904 filed Sep. 29, 1995 now abandoned.

DESCRIPTION

1. Technical Field

The present invention relates to a cover for protecting the base edge of a ground engaging implement of a work machine.

2. Background Art

Edge covers for protecting a base edge of a bucket or other ground engaging tool are well known in the art. These base edge covers and apparatus for retaining such covers to the base edge are of various construction. Most, if not all, of the heretofore designs have shortcomings that cause the end product to be less than desirable.

The primary factors desired in constructing an edge cover include characteristics such as long wear with minimal use of material, labor and natural resources, sufficient strength to withstand harsh environments and impacts, long service life span, little waste of materials after the cover is worn out, and quick and easy installation.

The present invention is directed to overcome one or more of the problems as set forth above.

DISCLOSURE OF THE INVENTION

In one aspect of the invention, apparatus are provided for protecting a base edge of a ground-engaging implement of a work machine. The base edge has an upper face and a lower face. The apparatus includes a base edge cover having a forward, ground-engaging portion and a rearward mounting portion. The rearward mounting portion has an upper flange element extending along the upper face of the base edge and a lower flange element extending along the lower face of the base edge that define a throat therebetween for receiving the base edge. The upper flange element has a rearward, downwardly-projecting hook portion having a convex frontal face thereon.

A mounting base is carried on the upper face of the base edge and has opposite sides and a forward, outwardly-opening cavity. The cavity has a concave frontal face thereon and a retainer opening through the one side in registry with the concave frontal face. The hook portion of the base edge cover is adapted to be received within the mounting base cavity and is positionable at a operative position where the convex face on the hook portion is disposed in a spaced, opposing relation to the concave face in the cavity to define an arcuate groove therebetween.

A curved retainer has a concave side and an opposite convex side and is adapted for receipt through a retainer opening into a retaining position within the arcuate groove such that the concave surface is disposed in close abutting relation to the convex face of the hook portion and the convex side is disposed in close abutting relation to the concave face of the cavity to prevent forward movement of the base edge cover relative to the mounting base.

BEST MODE FOR CARRYING OUT THE INVENTION

Figure 1:
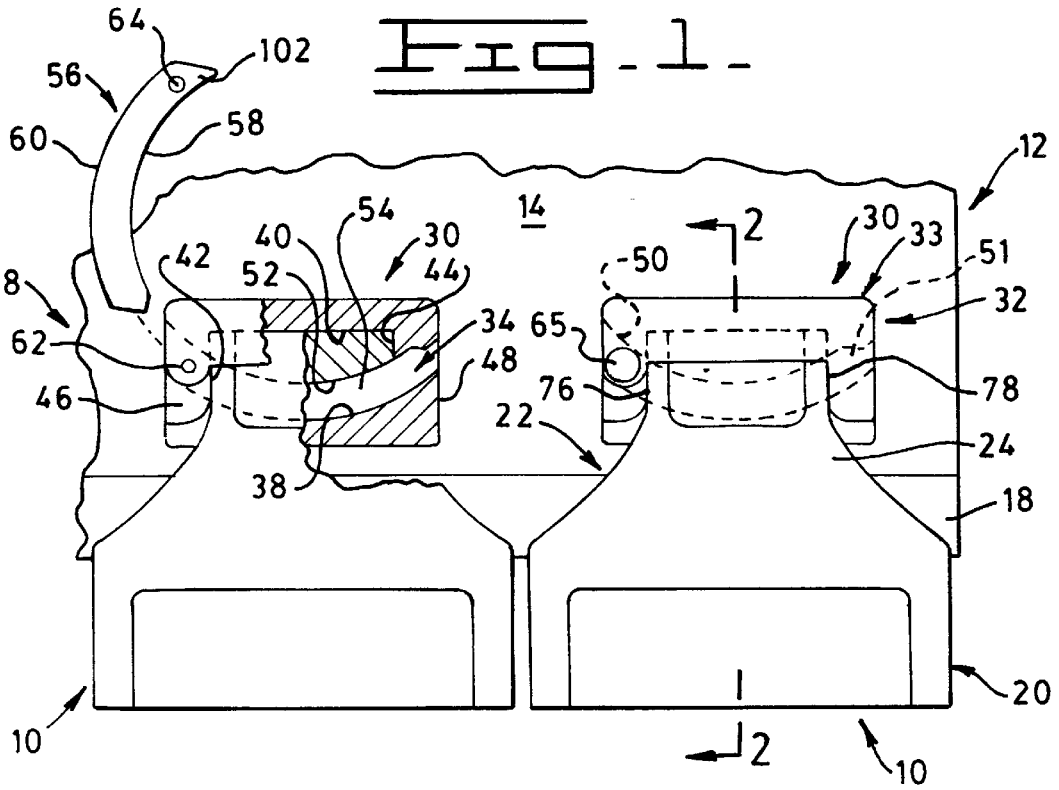
FIG. 1 is a diagrammatic top view of one embodiment of the invention.

Referring to FIGS. 1–11, apparatus 8 embodying the principles of the present invention is provided for protecting a base (cutting) edge 12 of a ground engaging implement, such as a bucket of a wheel loader (not shown). The typical base edge 12 is constructed from steel plate and has an upper face 14, a lower face 16 and a tapered leading edge 18. The base edge 12, as set forth above, is a portion of an implement of a work vehicle which is not shown for purposes of brevity, because such base edges for work vehicle implements are well known in the art.

Figure 2:
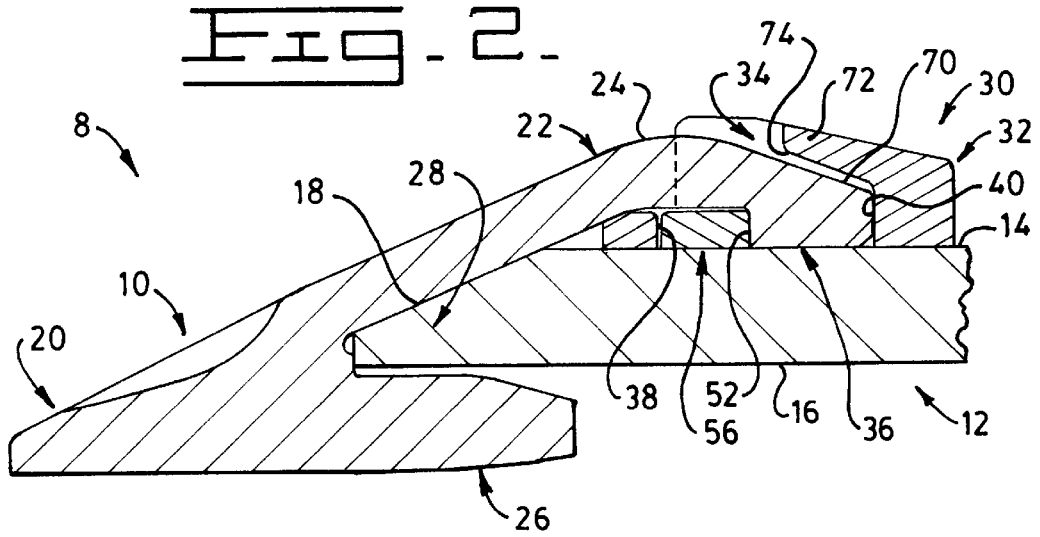
FIG. 2 is a diagrammatic cross-sectional view taken along line 2—2 of FIG. 1.

Apparatus 8 may include any number of base edge covers, two of which are shown at 10 in FIG. 1, along the length of the base edge 12. Each base edge cover 10 is generally wedge-shaped, with a forward, ground-engaging portion 20 and a rearward, mounting portion 22 as shown in FIG. 2. The mounting portion 22 has first and second spaced-apart flange elements: an upper flange element 24 and a lower flange element 26. These flange elements define a base edge receiving throat 28 therebetween.

The base edge cover 10 is constructed in conjunction with, and apparatus 30 is provided for, detachably retaining the base edge cover 10 on the base edge 12. Apparatus 30 includes a mounting base 32 that is carried on the base edge 12. Such mounting base 32 is secured, preferably by welding, to the upper face 14 of the base edge, but, without departing from this invention, can be a unitary portion of the base edge 12 or connected thereto by bolts or other means. The mounting base 32 is provided with a forward, outwardly-opening cavity 34 that is adapted to receive a rearward, downwardly-projecting hook portion 36 provided on the upper flange element 24 of the base edge cover 10. The cavity 34 is provided with a concave frontal face 38, a rearward face 40 and a pair of opposite side faces 42, 44.

The mounting base 32 has opposite sides 46 and 48, one of which includes a retainer opening 50 therethrough, which is aligned with the concave frontal face 38. The opening 50 is also preferably arcuate, as will be understood later.

The hook portion 36 on the upper flange element 24 has a convex frontal face 52 thereon. The hook portion 36 is positionable in the cavity 34 in an operative position where its convex face 52 is disposed in a predetermined, spaced-opposing relation to the concave face 38 of the cavity 34 so as to define an arcuate groove 54 therebetween.

Apparatus 8 also includes a curved retainer 56. Retainer 56 is provided with opposite end portions 102, a concave side 58 and a convex side 60 and is adapted for receipt through the arcuate retainer opening 50 to a retaining position within the arcuate groove 54. In such retaining position, the concave side 58 is disposed in close, abutting position to the convex face 52 of the hook portion 36 and the convex side 60 is disposed in close, abutting position to the concave face 38 of the cavity 34 in order to restrict forward movement of the base edge cover 10 relative to the mounting base 32.

The invention also includes a keeper 65 that is interengageable between the mounting base 32 and at least one of the end portions 102 of the curved retainer 56. The keeper 65 keeps the retainer 56 in place during use and allows the removal of retainer 56 to facilitate the replacement of the edge cover 10.

Figure 3:
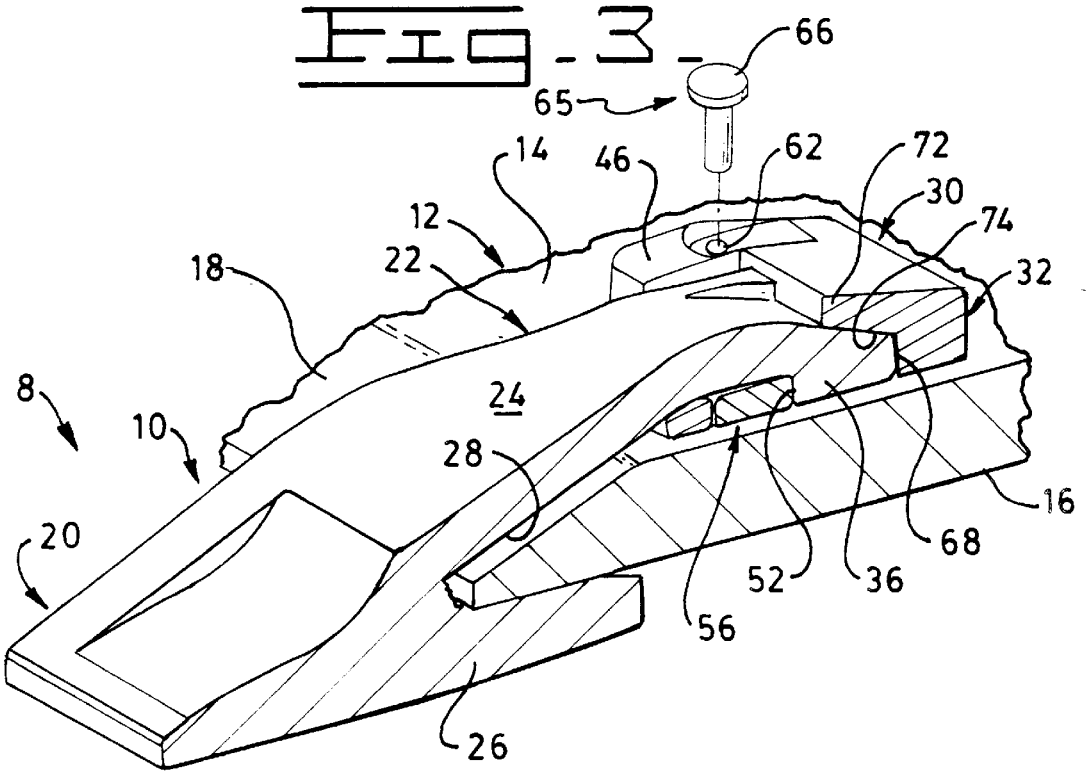
FIG. 3 is a diagrammatic cross-sectional view similar to FIG. 2, but with the components shown in perspective.

In the embodiment shown in FIGS. 1–3, the keeper is a flat-headed pin 66. To accommodate pin 66, the mounting base 32 is provided with a pin receiving hole 62 therein adjacent the one side 46 and located through the retainer opening 50. The retainer 56 is provided with a like pin-receiving hole 64 positionable in registry with the hole 62 in the mounting base 32 when the retainer 56 is disposed in its retaining position.

The pin 66 is positionable through the pin-receiving holes 62, 64 for selectively maintaining the retainer 56 in its retaining position. The pin 66 is preferably of a self-locking type of any known construction to prevent its dislodgement during use. For instance, the shank of the pin 66 may have a longitudinal groove filled with an elastomer to provide an interference fit between the pin 66 and the pin-receiving holes 62, 64.

The hook portion 36 also has a rearward face 68 that mates with and is disposed in close, abutting-relation to the rearward face 40 of the cavity 34 when the hook portion is in its operative position. The hook portion 36 has an upper surface 70, while the mounting base 32 has a forwardly-extending flange portion 72 located to overhang the cavity 34. The flange portion 72 has an inner surface 74 that is disposed in opposing relation to the upper surface 70 of the hook portion 36 when the hook portion is in its operative position so as to restrict upward movement of the hook portion 36 relative to the mounting base 32.

The hook portion 36 has opposite sides 76 and 78 as is seen in FIG. 1, each of which is positionable in close, abutting relation to a respective one of the opposite side faces 42, 44 of the cavity 34 so as to restrict lateral movement of the base edge cover 10 relative to the mounting base 32.

Figure 4:
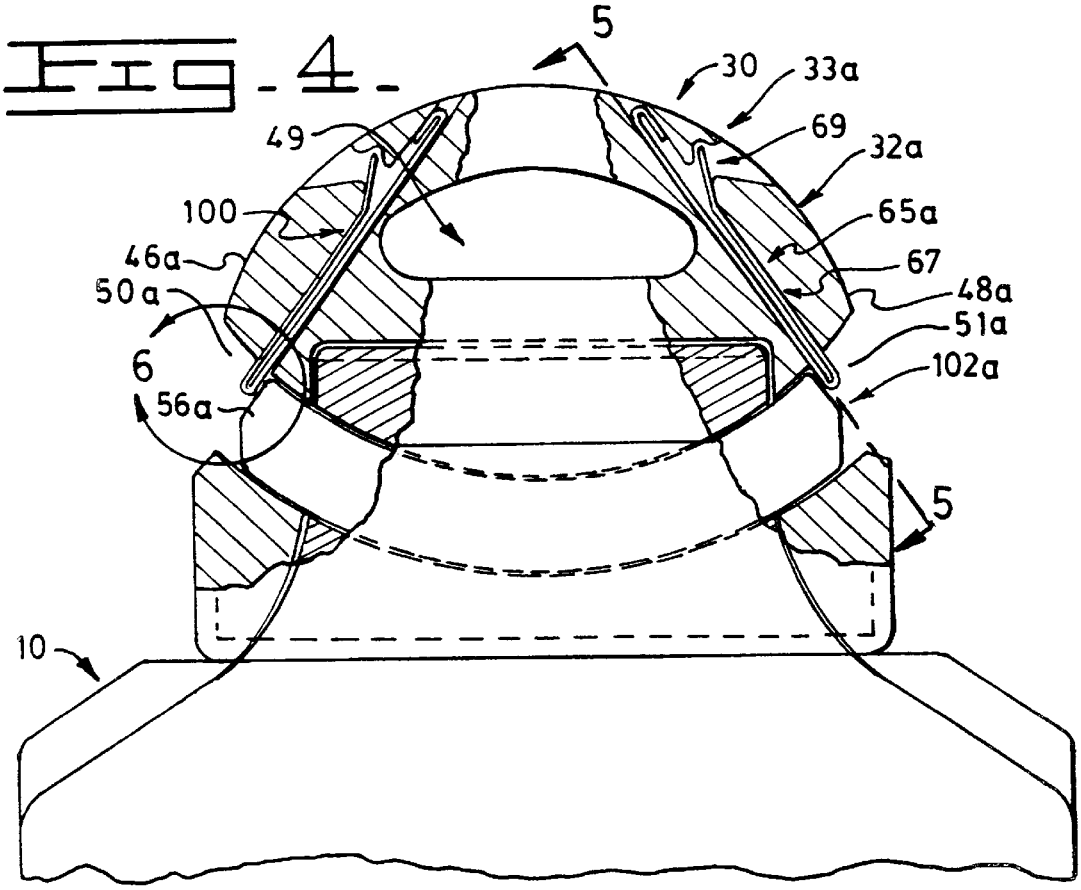
FIG. 4 is a diagrammatic top view of another embodiment of the invention.
Figure 5:
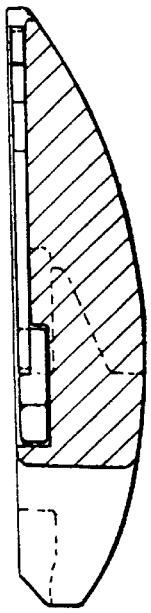
FIG. 5 is a diagrammatic cross-sectional view taken along line 5—5 of FIG. 4.
Figure 6:
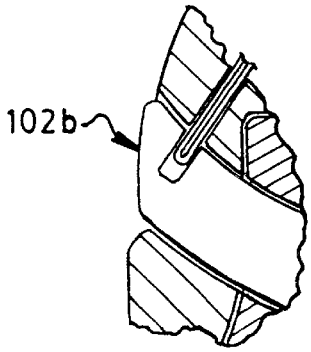
FIG. 6 is a diagrammatic view of still another embodiment of the detail labeled "6" in FIG. 4.
Figure 7:
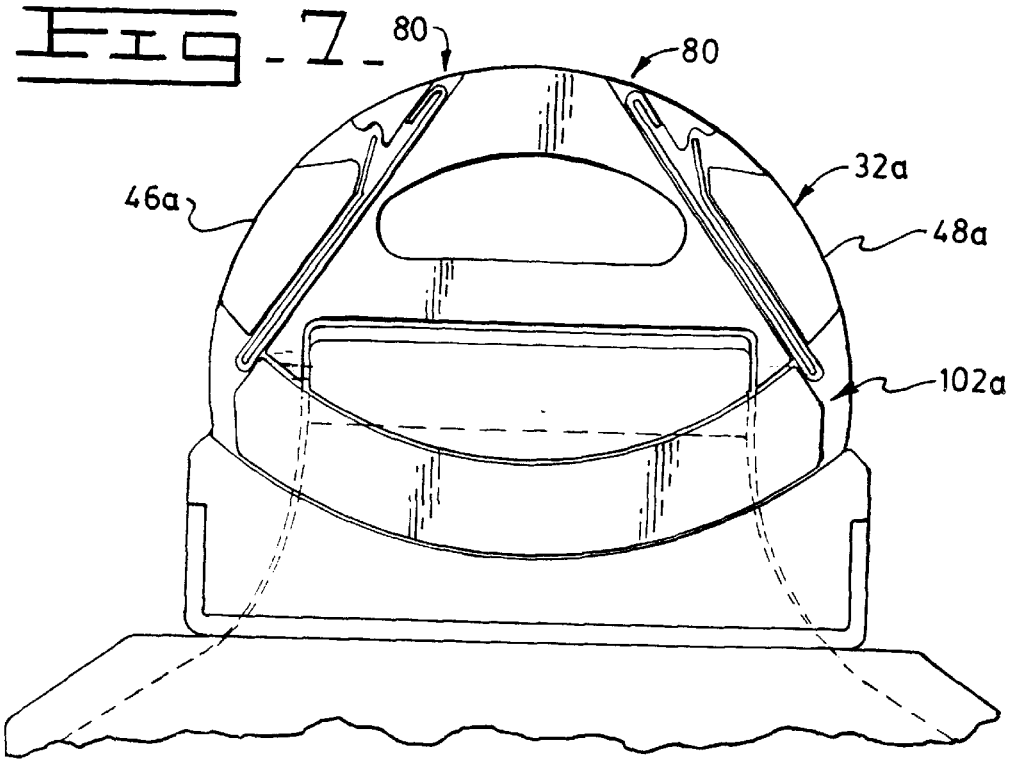
FIG. 7 is a bottom view of the embodiment illustrated in FIG. 4.

In another embodiment of the present invention illustrated in FIGS. 4–7, the base edge cover 10 is the same as in the preceding embodiment, while the mounting base 32*a* and retainer 56*a* are somewhat different and an alternate keeper arrangement 65*a* is shown. In particular, the mounting base 32*a* has an enlarged top end portion 33*a*, which is rounded as shown in FIG. 4 and is not provided with the pin receiving hole 62. Instead, the mounting base 32*a* is provided with pair of first spring clip guideways 80. Each guideway 80 is located on a respective one of the opposite sides 46*a*, 48*a* of the mounting base 32*a* and extend from the top of the mounting base 32*a* and open into a respective one of a pair of retainer openings 50*a* and 51*a*. The retainer 56*a* does not have the pin receiving hole 64.

The keeper arrangement 65*a* includes a pair of long, narrow, first spring clips 67. Each spring clip 67 has a flexible detent finger 69 extending laterally therefrom. Each of the first spring clip guideways 80 has a detent cavity 82, which is configured to accept the detent finger 69 of its respective spring clip 67. Each of the spring clips 67 is adapted to be fitted into a respective one of the pair of first spring clip guideways 80. The detent finger 69 snaps into the cavity 82 upon installation of the clip 67, thereby restricting movement of the clip 67. When in its installed position, each of the spring clips 67 has an end portion that extends into its respective retainer opening 50*a*, 51*a* for close abutting relation with an adjacent end 102*a* of the curved retainer 56*a*, thereby preventing the escape of the retainer 56*a* from the arcuate groove 52. As may be seen in FIG. 6, the keeper arrangement 65*a* may be modified to include an extended end portion 102*b* of the retainer 56*a*. This keeper arrangement eliminates the requirement for two first spring clips 67 inasmuch as one first spring clip 67 prevents movement in both directions of the retainer 56*a*.

The first spring clip guideway 80 includes an access port 84, which port opens through an adjacent side 46*a*, 48*a* of the mounting base 32*a*. The port 84 provides access to the detent finger 69 for releasing the finger 69 from the detent cavity 82, thereby permitting removal of the clip 67, which then allows the retainer 56*a* to be removed.

Figure 8:
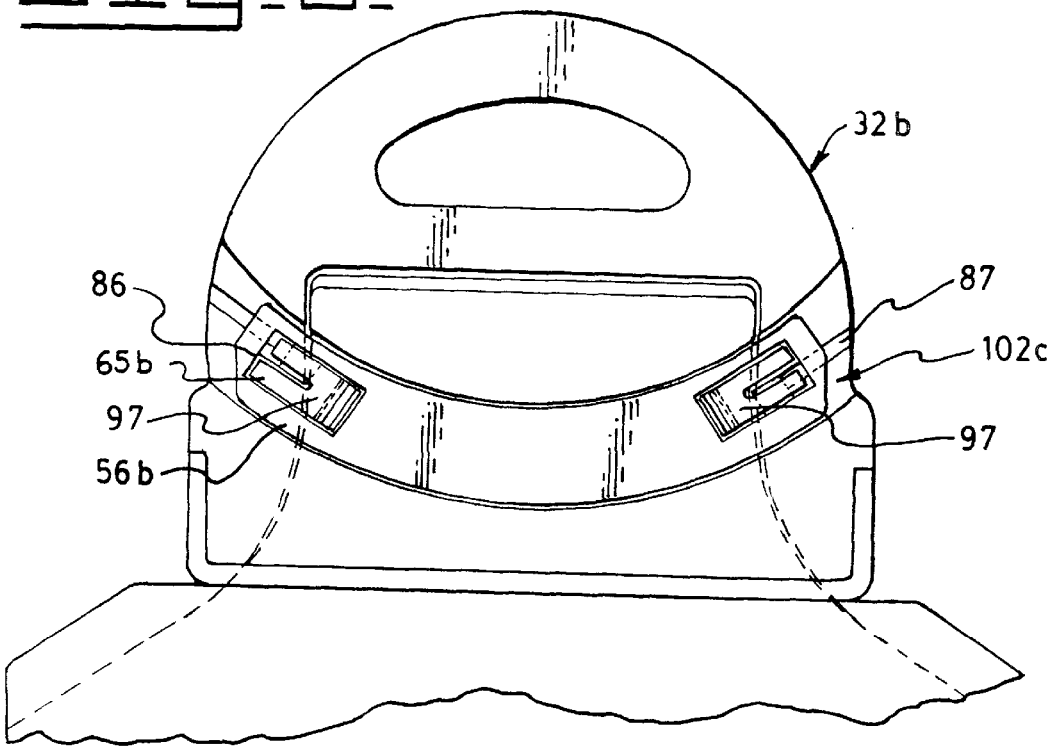
FIG. 8 is a bottom view similar to FIG. 7, but illustrating still another embodiment of the invention.
Figure 11:
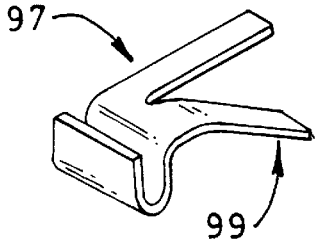
FIG. 11 is an isometric view of one of the retaining keepers shown in FIG. 8.

In an alternate embodiment shown in FIGS. 8 and 11, a keeper 65*b* is disclosed which includes a pair of second spring clips 97. Here, the clips 97 are adapted to interengage in a self-locking manner with the retainer 56*b* and the mounting base 32*b* so as to restrict movement of the retainer 56*b* in either direction.

Figure 9:
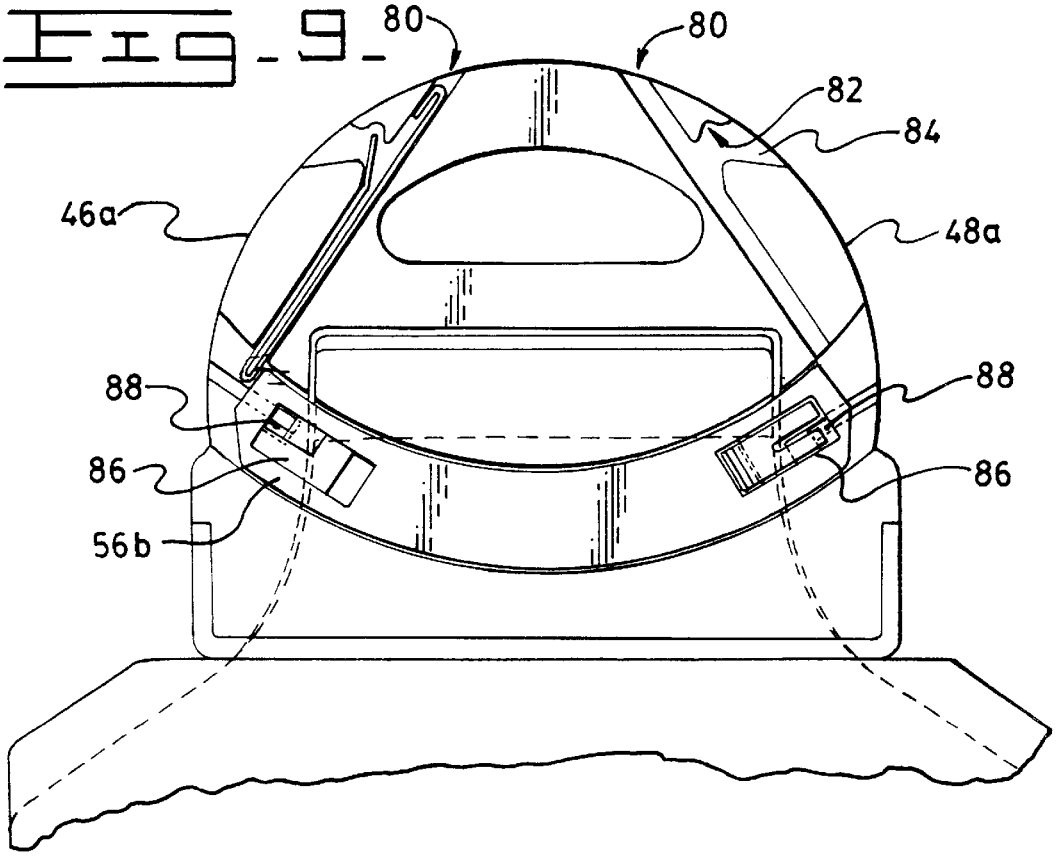
FIG. 9 is a bottom view similar to and combining features of the embodiments illustrated in FIGS. 7 and 8.
Figure 10:
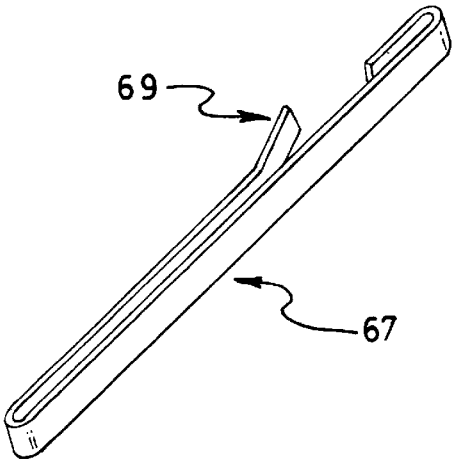
FIG. 10 is an isometric view of one of the retaining keepers shown in FIG. 4.

Each second spring clip 97 has a resilient, extensible detent finger 99. The retainer 56*b* has at least two pockets 86 as seen in FIG. 9. Each pocket 86 is located in a end portion 102*c* of the retainer 56*b* for receiving one each of the second spring clips 97. The mounting base 32*b* has two detent cavities 88 on opposite sides 46*a* and 48*a*, each cavity 88 being adapted to receive one detent finger 99. Each detent finger 99 engages in a mounting base detent cavity 88, so as to restrict movement of the retainer 56*b* in either direction. The second spring clip 97 may be removed by inserting a prying tool (not shown) into a second spring clip access port 87 and raising the detent finger 99.

The apparatus 8 may be configured as in FIG. 9, wherein the keeper includes one first spring clip 67 for restricting movement of the retainer 56*b* in one direction and a second spring clip 97 for restricting movement of the retainer 56*b* in the opposite direction.

The mounting base 32*a* or 32*b* may include a weld pocket 49 which provides an inner-circumference edge for attaching the mounting base 32*a* or 32*b* onto the base edge 12 by welding. A weld bead along the inner-circumference edge is protected from wear due to abrasion because the recessed nature of the pocket 49 prevents direct, impinging contact with the work machine load.

INDUSTRIAL APPLICABILITY

The apparatus 8 of the present invention provides a base edge cover 10 that is securely attached to the base edge 12 during use, but is easily removed when worn out and replaced with a new base cover and represents a saving of labor and machine down time.

In operation, the base edge cover 10 is easily and quickly installed by inserting the hook portion 36 into the cavity 34 of the mounting base 32. The cover 10 is slid rearwardly until the leading edge 18 of the base edge makes contact with and is seated in the throat 28 of the mounting portion 22 of the cover 10. Once the cover 10 is in its operative position, as best shown in FIG. 2, the curved retainer 56 can be readily inserted through the retainer opening 50 in the mounting base 32 and into the arcuate groove 54. Once the retainer is in its retaining position, a keeper 65 can be inserted to keep the retainer in place during use. As shown in FIG. 1, the retainer opening 50 is formed in an arcuate configuration to match the retainer 56 and is located to be in registry with the arcuate groove 54 to facilitate the installation of the retainer.

As is readily apparent from the drawings, the hook portion 36 becomes locked or trapped within the cavity 34 once the retainer 56 is in place. As a consequence, the base edge cover 10 is securely mounted to the base edge 12 and cannot come off during use.

As seen in FIG. 1, the use of a retainer, such as retainer 56 with its curved configuration advantageously permits the insertion of the retainer along an arcuate path for the side and behind the mounting base 32 and the cover 10. The allows the close, side-by-side location of adjacent covers, without such closeness being a hindrance to the insertability of the retainer 56.

Other aspects, objects and advantages of this invention can be obtained from a study of the drawings, the disclosure and the claims.

I claim:

1. An apparatus for protecting a base edge of a ground engaging implement of a work machine, said base edge having an upper face and a lower face, comprising:

a base edge cover having a forward ground engaging portion and a rearward mounting portion, said rearward mounting portion having an upper flange element extendible along said upper face of the base edge and a lower flange element extendible along the lower face of said base edge and defining a throat therebetween for receiving said base edge, and said upper flange element having a downwardly projecting hook portion having a convex frontal face thereon;

a mounting base capable of being carried on the upper face of said base edge, said mounting base having opposite sides, a retainer opening and an outwardly opening cavity, said cavity having a concave frontal face thereon and said retainer opening being located through at least one of said opposite sides and being separate from said cavity so as to open said cavity in alignment with said concave frontal face;

said hook portion being adapted to be received within said cavity of said mounting base and positionable at an operative position where said convex face on said hook portion is disposed in a spaced opposing relation to said concave face of said cavity to define an arcuate groove therebetween;

a curved retainer having a concave side, an opposite convex side and opposite end portions, said retainer being adapted for receipt through said retainer opening into a retaining position within said arcuate groove such that said concave surface is disposed in close abutting relation to said convex face of said hook portion and said convex side is disposed in close abutting relation to said concave face of said cavity to restrict forward movement of said base edge cover relative to said mounting base; and a keeper interengageable between the mounting base and one of said end portions of said curved retainer to maintain said retainer in place during use, but allow the removal of said retainer to facilitate the replacement of said edgecover.

2. The apparatus of claim 1 wherein said mounting base includes a pin receiving hole therein adjacent said one side of said mounting base and located through said retainer opening, said retainer having a like pin receiving hole positionable in registry with said hole in said mounting base when said retainer is disposed in its retaining position; and a pin, positionable through said hole of the mounting base and retainer, for selectively maintaining said retainer in its retaining position.

3. The apparatus, as set forth in claim 1, wherein said cavity has a rearward face and said hook portion has a mating rearward face disposed in close abutting relation to said rearward face of said cavity when said hook portion is in its operative position.

4. The apparatus, as set forth in claim 3, wherein said hook portion has an upper surface and said mounting base has a forwardly projecting flange portion that is located to overhang said cavity, said flange portion having an inner surface disposed in opposing relation to said upper surface of said hook portion when said hook portion is disposed in its operative position to restrict upward movement of said hook portion relative to said mounting base.

5. The apparatus, as set forth in claim 4, wherein said cavity of said mounting base has opposite side faces and said hook portion has opposite sides, each of said sides being positionable in close abutting relation to a respective one of said side faces of the cavity when said hook portion is disposed in its operative position to restrict lateral movement of said base edge cover relative to said mounting base.

6. The apparatus, as set forth in claim 1, wherein said keeper includes a first spring clip and said mounting base has at least one first spring clip guideway, said first spring clip guideway being located through one of said opposite sides of said mounting base and opening into said retainer cavity, such that said first spring clip passes through said keeper guideway into said retainer cavity and engages with said retainer.

7. The apparatus, as set forth in claim 6, wherein said guideway has a detent cavity and said first spring clip has a flexible detent finger thereon and adapted to snap into said detent cavity upon the installation of said first spring clip into said guideway for restricting movement of said first spring clip, and wherein said guideway includes an access port opening through the adjacent side of said mounting base to provide access to said detent finger for releasing said finger from said detent cavity to permit the removal of said first spring clip.

8. The apparatus, as set forth in claim 7, wherein said mounting base includes another spring clip guideway located at the other side thereof and wherein another of said first spring clips is positionable within the other spring clip guideway, each of said first spring clips being disposed in a respective one of said guideways and having an end portion disposed in abutting relation against a respective end portion of said retainer to restrict movement of said retainer in either direction.

9. The apparatus of claim 1, wherein said keeper includes a pair of second spring clips carried on said retainer, said second spring clips being adapted to interengage in a self-locking manner with said mounting base so as to restrict movement of said retainer in either direction.

10. The apparatus of claim 9, wherein each of said second spring clips has a resilient detent finger extending therefrom, said retainer has a pocket in each end portion thereof for receiving a respective one said second spring clips, said mounting base has a pair of detent cavities adapted to receive a respective one of said fingers, and said mounting base has a removal access port for each detent cavity.

11. The apparatus of claim 1, wherein said retainer has a pair of end portions and said keeper includes a first spring clip for restricting movement of said retainer in one direction at one end portion and a second spring clip for restricting movement of said retainer in the opposite direction at another end portion.

12. The apparatus of claim 1, wherein said mounting base includes a weld pocket with an inner circumference for weld attachment to said base edge.

* * * * *